US006102394A

United States Patent [19]

Wurz et al.

[11] Patent Number: 6,102,394

[45] Date of Patent: Aug. 15, 2000

[54] BUTTON PANEL SYSTEM FOR A GAMING DEVICE

[75] Inventors: Norman R. Wurz, Des Plaines; James M. Rasmussen, Chicago, both of Ill.

[73] Assignee: WMS Gaming, Inc., Chicago, Ill.

[21] Appl. No.: 09/351,776

[22] Filed: Jul. 12, 1999

[51] Int. Cl.[7] ..... A63F 3/00; A63F 9/24

[52] U.S. Cl. ..... 273/138.2; 273/138.1; 273/143 R; 200/5 R; 200/5 A; 200/296; 463/20

[58] Field of Search ..... 273/138.1; 73/1.19, 73/1.23, 1.56; 463/20; 356/402; 40/464; 359/138, 139, 142, 147; 200/5 R, 5 A, 520, 293, 295, 296, 341, 345

[56] References Cited

U.S. PATENT DOCUMENTS

| | | | |
|---|---|---|---|
| 3,210,484 | 10/1965 | Dorsey | 200/5 |
| 4,092,527 | 5/1978 | Luecke | 35/5 |
| 4,945,194 | 7/1990 | Berger | 200/5 R |
| 5,015,829 | 5/1991 | Eilert et al. | 200/296 |
| 5,173,795 | 12/1992 | Branan, Jr. et al. | 359/142 |
| 5,342,047 | 8/1994 | Heidel et al. | 463/20 |
| 5,455,743 | 10/1995 | Miyajima . | |
| 5,695,188 | 12/1997 | Ishibashi | 463/20 |
| 5,704,835 | 1/1998 | Dietz, II | 463/20 |
| 5,737,039 | 4/1998 | Lopez et al. . | |
| 5,951,397 | 9/1999 | Dickinson | 463/36 |
| 5,984,782 | 11/1999 | Inoue | 463/20 |

*Primary Examiner*—Jessica J. Harrison
*Assistant Examiner*—Dolores R. Collins
*Attorney, Agent, or Firm*—Jenkens & Gilchrist

[57] ABSTRACT

A gaming device comprises a cabinet with a hinged door, a gaming unit housed within the cabinet for playing a game, and a button panel system. The button panel system includes a printed circuit board mounted to the door and disposed inside the cabinet; a plurality of switches removably mounted to the printed circuit board; a button panel detachably mounted to the door in proximity to the printed circuit board and exposed to a player; a plurality of buttons mounted to the button panel in a preselected arrangement; and a plurality of actuators coupled to the respective buttons and disposed to actuate a group of the plurality of switches in response to pressing the respective buttons, the group of the plurality of switches cooperating with the game played by the gaming unit.

30 Claims, 10 Drawing Sheets

BUTTON PANEL SYSTEM FOR A GAMING DEVICE

FIELD OF THE INVENTION

The present invention relates generally to a button panel system for a gaming device and, more particularly, relates to a cost-effective button panel system that facilitates future modifications thereto.

BACKGROUND OF THE INVENTION

FIGS. 1 and 2 depict a prior art technique for mounting button assemblies to a gaming device which, in this case, is a slot machine. The slot machine includes a cabinet 10 having a hinged door 12. A button panel 14 supporting a plurality of button assemblies 15 is mounted to the door 12 below a rectangular opening 16 that exposes a video display 18 when the door 12 is closed (FIG. 2). When the slot machine is operating, the video display 18 depicts a plurality of slot reels 20. To play the slot machine, a player places a wager and then "spins" the slot reels 20. In response to a winning combination appearing on the pay line(s) of the slot reels 20, the slot machine pays out a monetary amount determined by a pay table listing the winning combination.

The button assemblies 15 on the button panel 14 are electrically connected to a gaming unit (not shown) inside the belly of the slot machine by electrical wires 22. A player may press various ones of the button assemblies 15 to cause the gaming unit to perform various functions, such as cash out, select pay lines, display the pay table on the video display 18, enter a wager, and spin the reels. Each button assembly 15 typically includes a variety of elements, such as a button, an actuator, a switch, and a light source. The actuator, switch, and light source are generally positioned beneath the button. The actuator is coupled to the button and disposed to actuate the switch in response to pressing the button. The light source is positioned to illuminate the button.

The process for manufacturing the slot machine in FIGS. 1 and 2 includes the following sequence of steps: (1) the button assemblies 15 are individually mounted to the button panel 14, (2) the electrical wires 22 are connected to appropriate ones of the button assemblies 15, (3) the button panel 14 is mounted to the door 12, and (4) the electrical wires 22 are fed through the belly of the slot machine and connected to the gaming unit. Thus, the button panel 14, button assemblies 15, and electrical wires 22 are built as a sub-assembly prior to mounting the button panel 14 to the door 12. This manufacturing technique has several drawbacks.

One drawback is that when the button panel 14 is mounted to the door 12, there is a significant possibility that one of the electrical wires 22 will be pinched between the button panel 14 and the door 12. Another drawback is that the wire side of the button assemblies 15 will become buried within the cluster of electrical wires 22 that are left under the button panel 14 (FIG. 2). This makes it difficult for a service technician to access any of the button assemblies 15 for maintenance or servicing (e.g., replacing burnt-out light sources). Yet another drawback is that conversion of the slot machine to a different game requiring a different button configuration is difficult. To perform such conversion, the original sub-assembly comprised of the button panel 14, the button assemblies 15, and the electrical wires 22 must be removed from the slot machine and replaced with a suitable new sub-assembly with the different button configuration. This requires a service technician to reach inside the slot machine and disconnect the original electrical wires 22 from the gaming unit, detach the button panel 14 from the door 12, mount the new sub-assembly to the door 12, and feed the electrical wires 22 through the belly of the slot machine for connection to the gaming unit.

Accordingly, there is a need for a new button panel system that overcomes the aforementioned shortcomings associated with existing techniques for mounting button assemblies to a gaming device.

SUMMARY OF THE INVENTION

In accordance with one aspect of the present invention, a gaming device comprises a cabinet with a hinged door, a gaming unit housed within the cabinet for playing a first game, and a button panel system. The button panel system includes a printed circuit board mounted to the door and disposed inside the cabinet; a plurality of switches mounted to the printed circuit board; a first button panel detachably mounted to the door in proximity to the printed circuit board and exposed to a player; a plurality of first buttons mounted to the first button panel in a first arrangement; and a plurality of first actuators coupled to the respective first buttons and disposed to actuate a first group of the plurality of switches in response to pressing the respective first buttons, the first group of the plurality of switches cooperating with the first game played by the gaming unit.

In accordance with another aspect of the present invention, a method of modifying the gaming device includes detaching the button panel from the door such that the button panel, the first buttons, and the first actuators are removed from the gaming device; supplying a second button panel, a plurality of second buttons, and a plurality of second actuators, the second buttons being mounted to the second button panel in a second arrangement different from the first arrangement, the second actuators being coupled to the respective second buttons; mounting the second button panel to the door in proximity to the printed circuit board such that the second actuators are disposed to actuate a second group of the plurality of switches in response to pressing the respective second buttons; and modifying the gaming unit to play a second game cooperating with the second group of the plurality of switches.

In accordance with a further aspect of the present invention, the switches are removably mounted to the printed circuit board via respective apertures formed in the printed circuit board to facilitate repair or replacement of individual ones of the switches.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
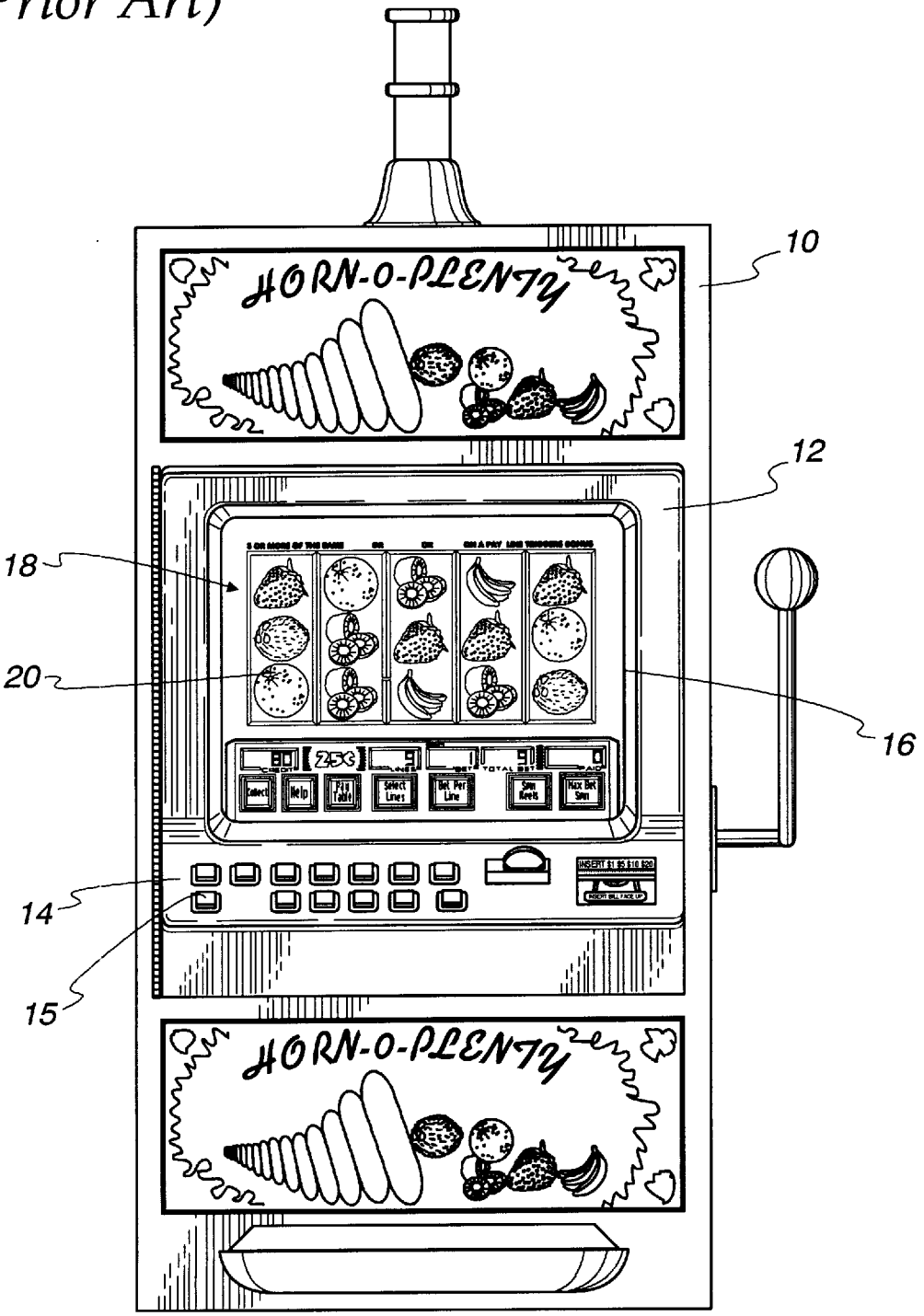
Fig. 1 (Prior Art)
FIGS. 1 and 2 are front views of a gaming device showing a prior art technique for mounting button assemblies thereto.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

DESCRIPTION OF ILLUSTRATIVE EMBODIMENTS

Figure 2:
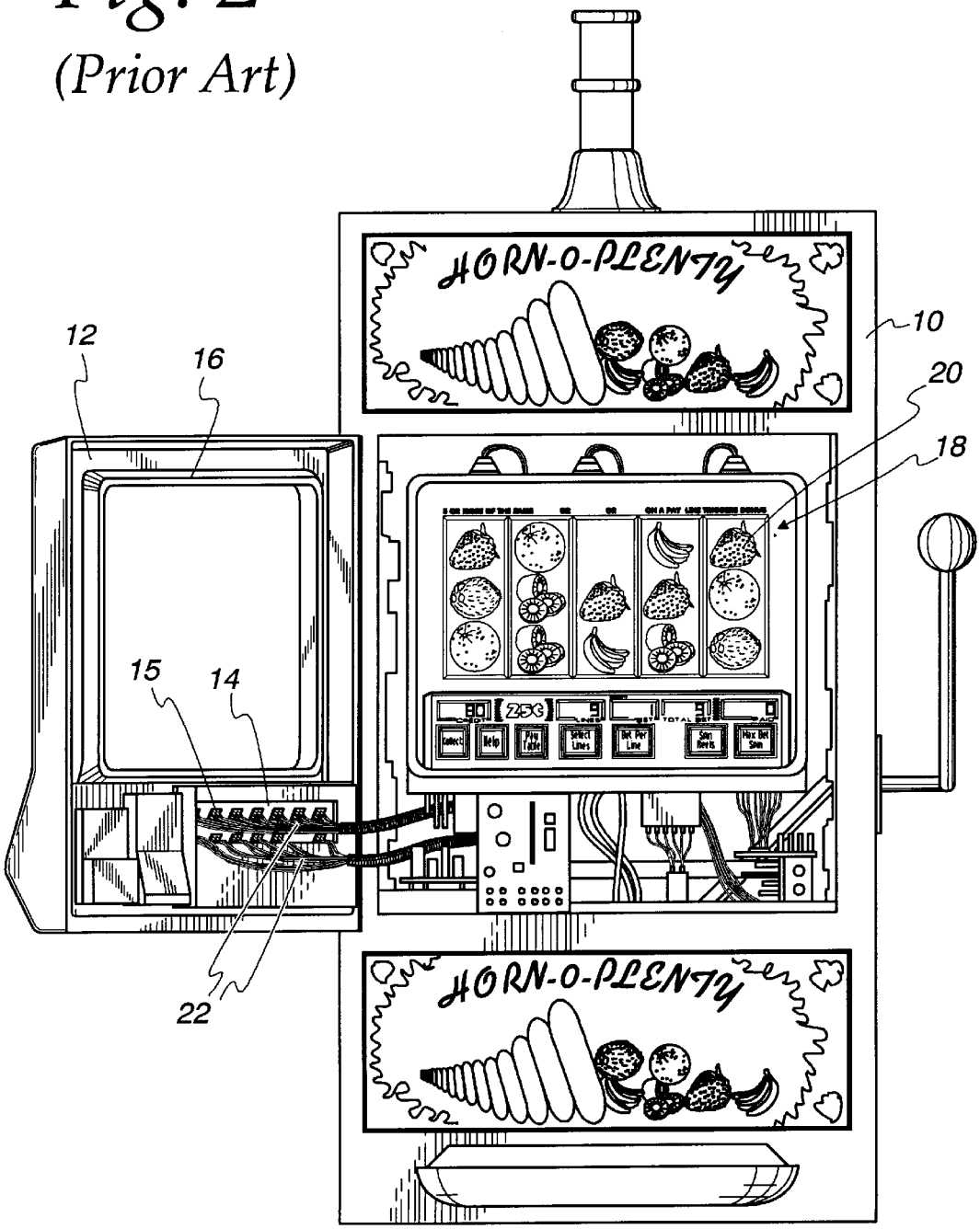
Fig. 2 (Prior Art)
Figure 3:
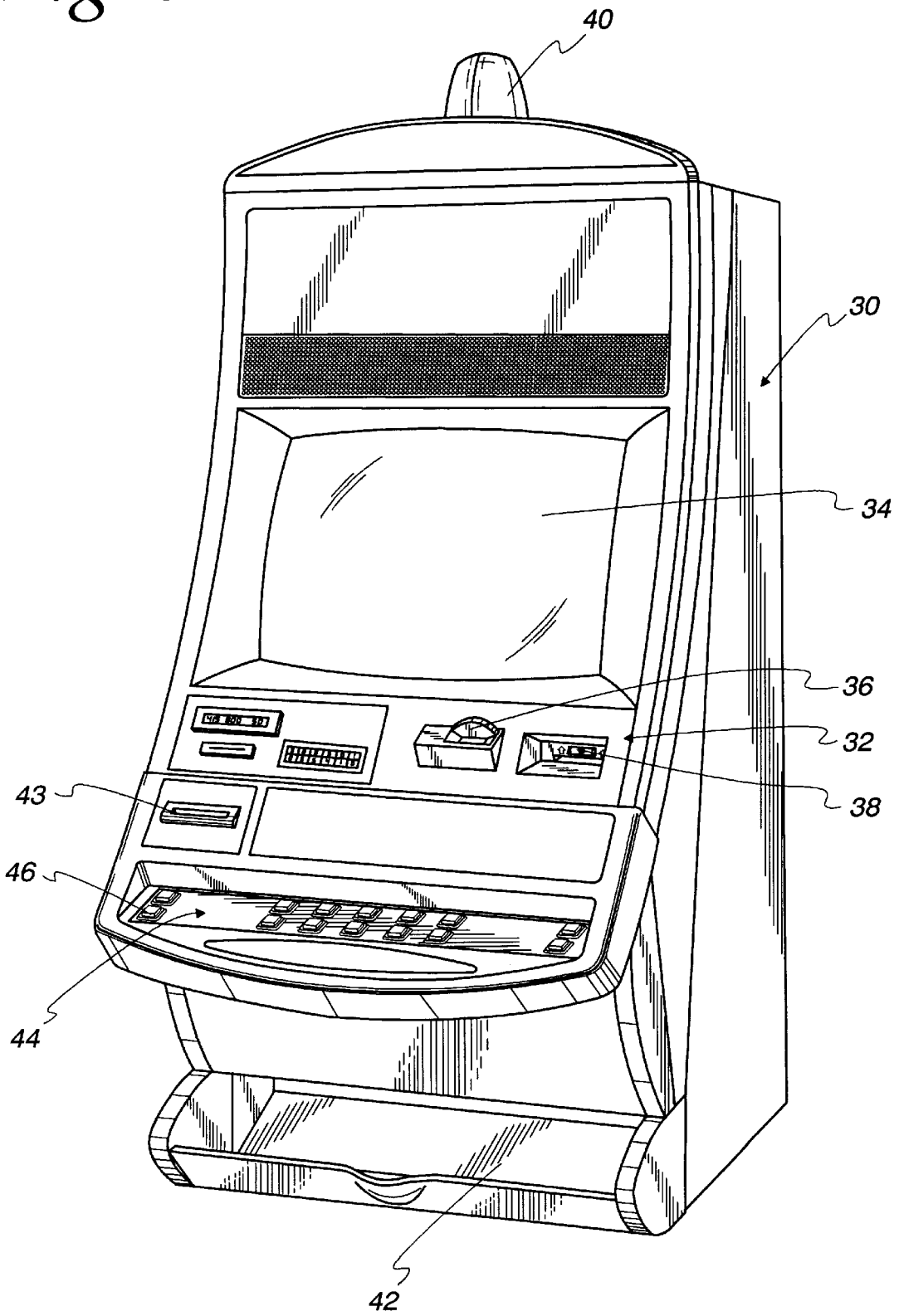
FIG. 3 is an isometric view of a gaming device incorporating a button panel system embodying the present invention.

FIG. 3 depicts a gaming device incorporating a button panel system embodying the present invention. The gaming device may, for example, be a slot machine, a video lottery terminal, or any other machine on which a player places a wager on a game of chance for an opportunity to win some sort of monetary or non-monetary prize. The illustrated gaming device includes a cabinet 30 having a hinged door 32. The hinged door 32 includes a rectangular opening that exposes a video display 34 when the door is closed. When the gaming device is operating, the video display 34 depicts a game of chance, which may, for example, include a plurality of slot reels of the type shown in FIGS. 1 and 2. Beneath the video display 34 are a coin acceptor 36 and a bill acceptor 38 for receiving wagers. The gaming device illuminates a light 40 in response to a win occurring on the game of chance and dispenses payouts resulting from the win to a coin tray 42 and from a bill hopper 43. Also, the light 40 may be illuminated to indicate an error condition or a request for service. A button panel system 44 is mounted to the door 32 beneath the coin and bill acceptors 36 and 38.

Figure 4:
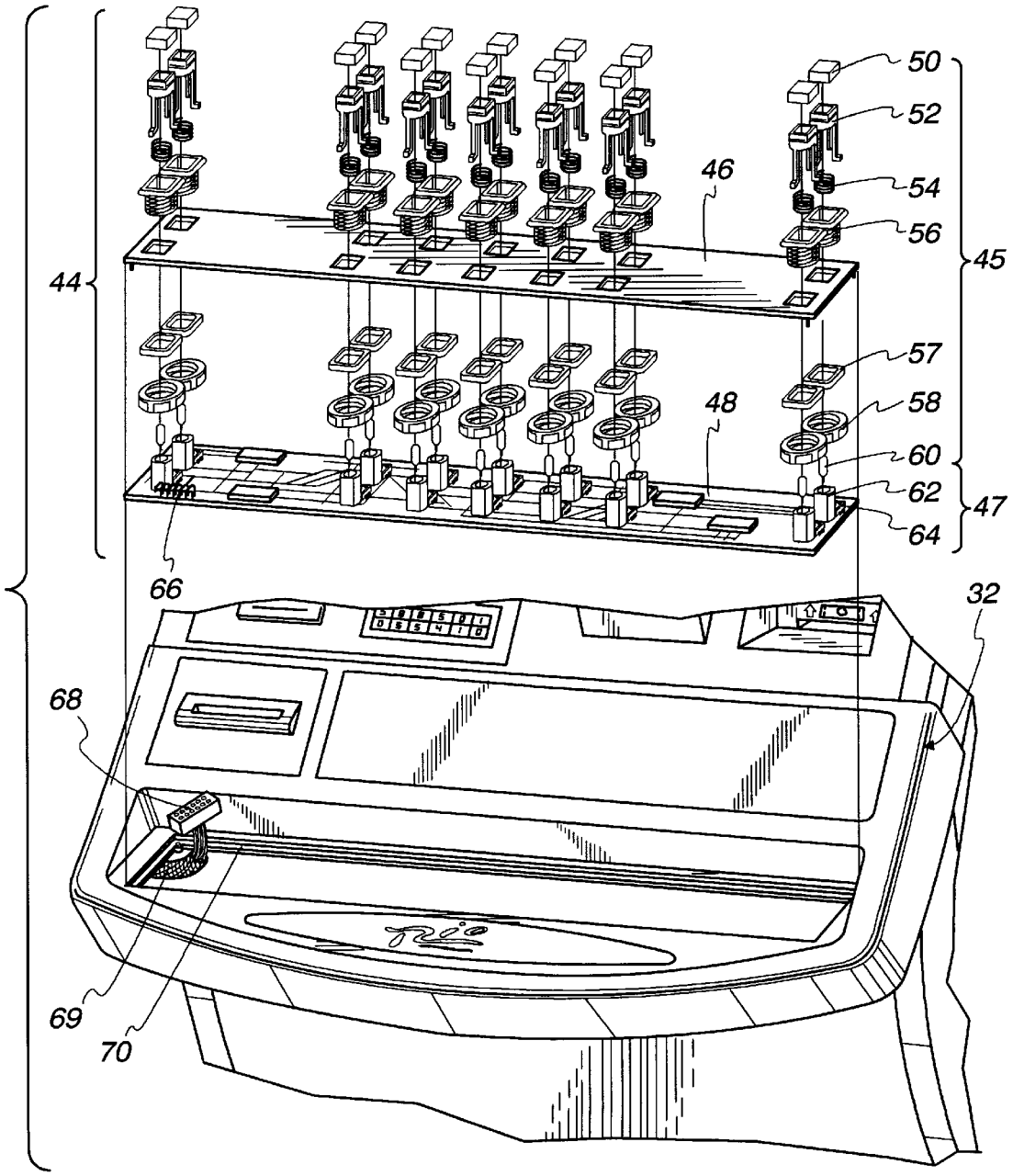
FIG. 4 is an exploded isometric view of the button panel system.
Figure 5:
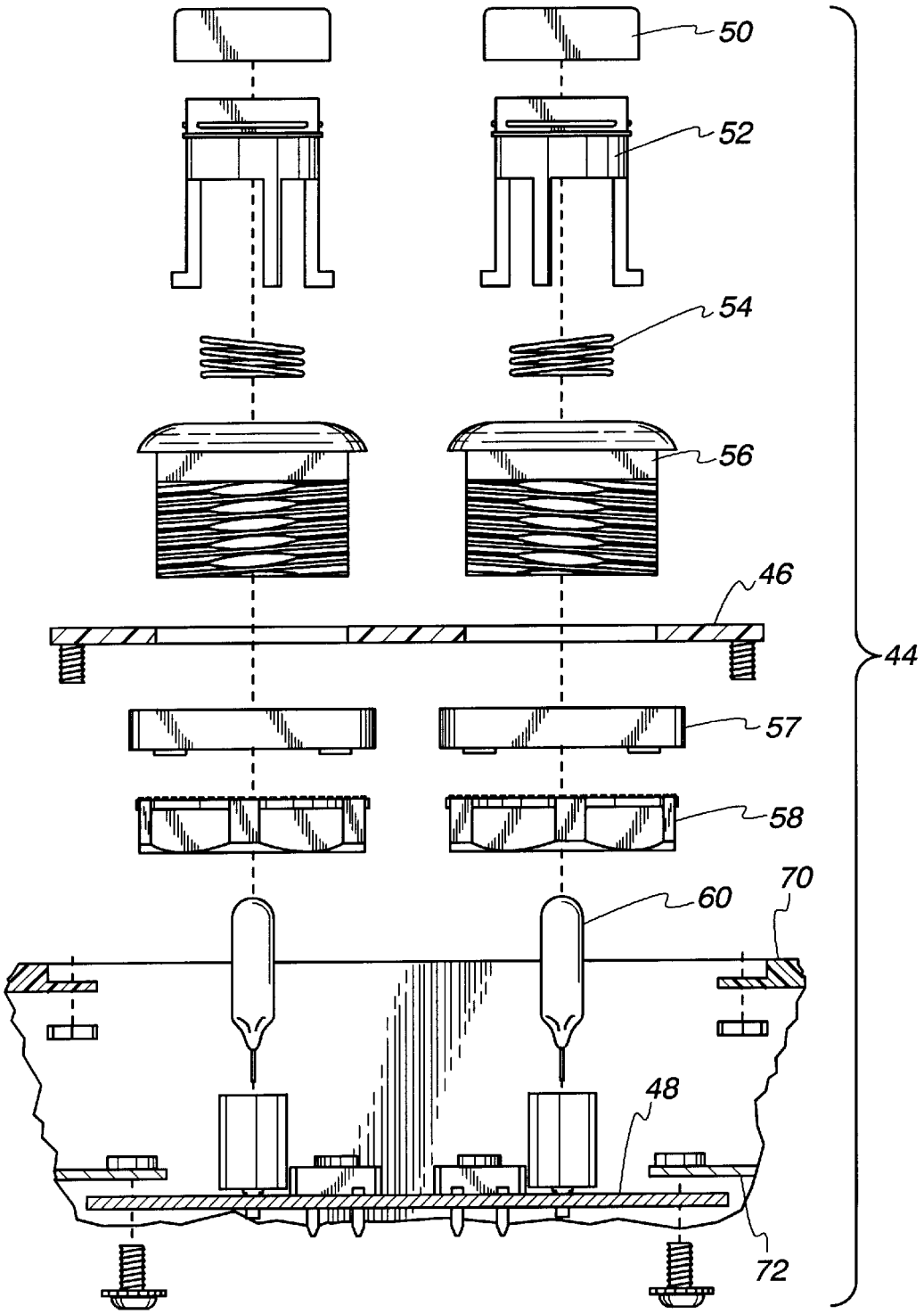
FIG. 5 is an enlarged exploded side view of the button panel system.

FIG. 4 depicts an exploded view of the button panel system 44. The button panel system 44 includes a button panel assembly 45 and a printed circuit board assembly 47. The button panel assembly 45 includes a button panel 46 and actuator assemblies 50, 52, 54, 56, 57, 58 (hereinafter "50–58") while the printed circuit board assembly 47 includes a printed circuit board 48, switch assemblies 60, 62, 64 (hereinafter "60–64") and an electrical connector 66. Fourteen actuator assemblies 50–58 and fourteen corresponding switch assemblies 60–64 are depicted in FIG. 4. FIG. 5 is an enlarged exploded side view of the button panel system 44. The actuator assemblies 50–58 are assembled on the button panel 46, while the switch assemblies 60–64 and the electrical connector 66 are assembled on the printed circuit board 48.

Figure 6A:
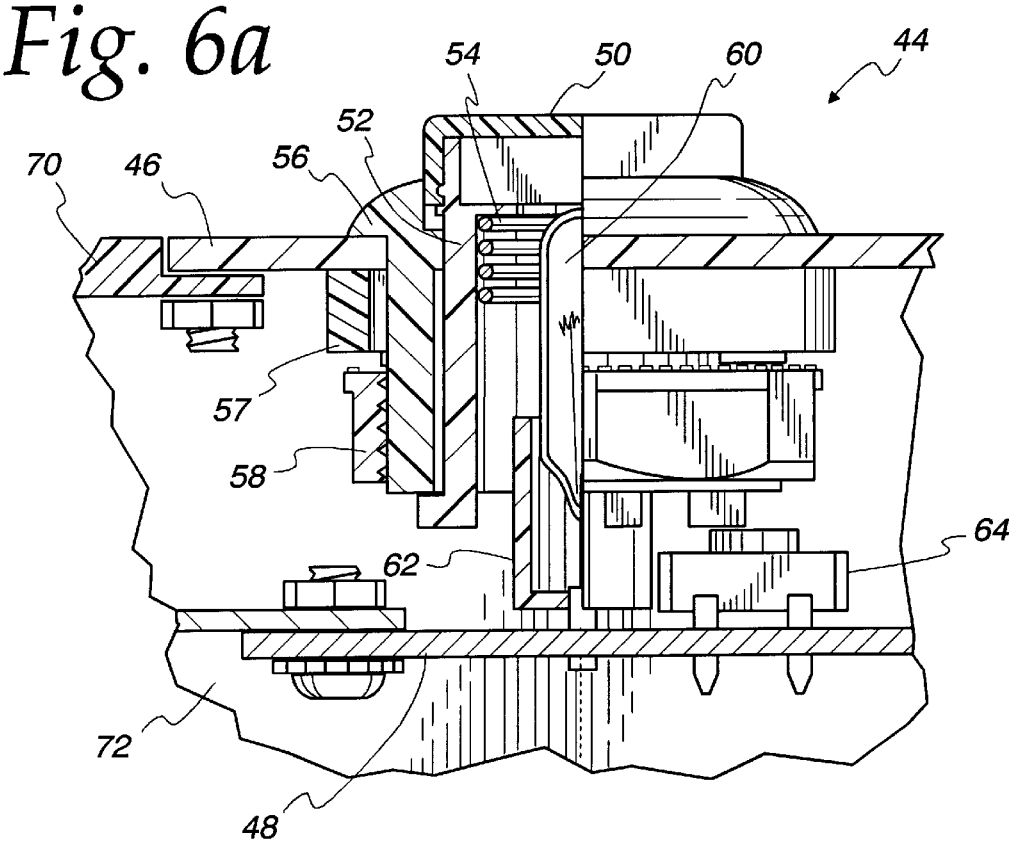
FIG. 6*a* is an enlarged partial side view of the button panel system with portions broken away to reveal internal structure.
Figure 6B:
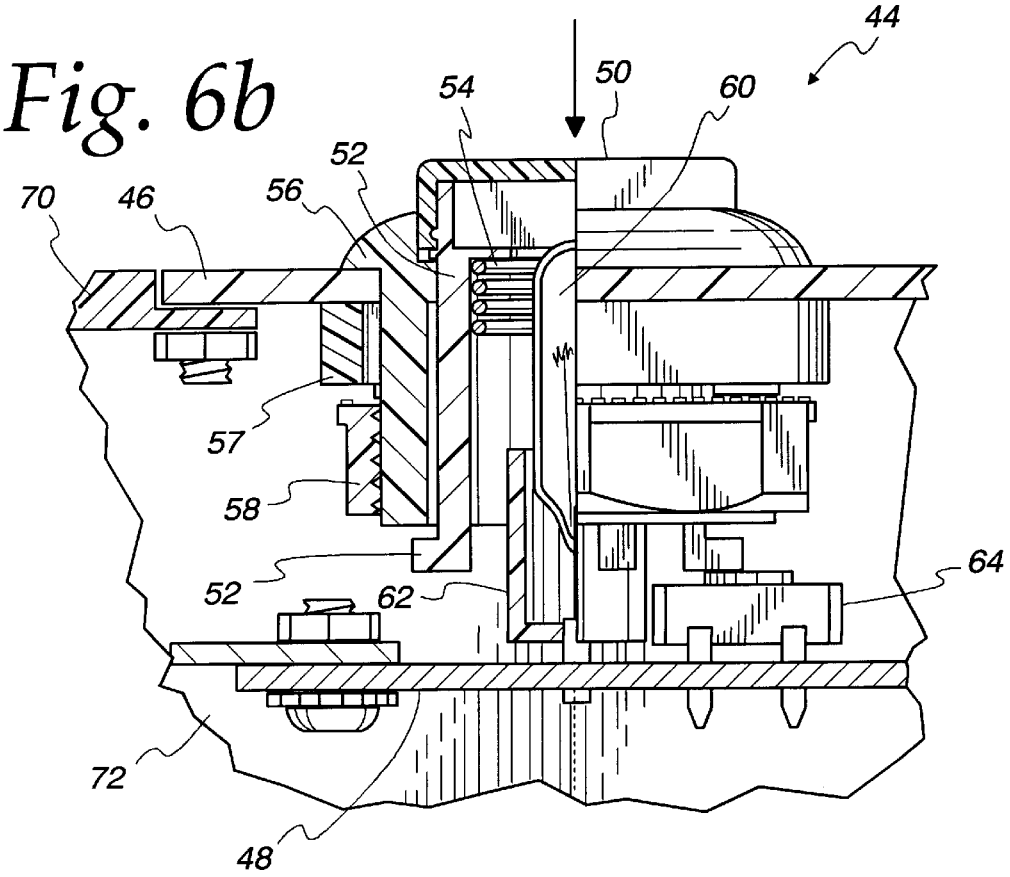
FIG. 6*b* is similar to FIG. 6*a* but showing a button being pressed to actuate a corresponding switch.

Referring to FIGS. 4 and 5, each actuator assembly includes a lens 50, an actuator 52, a compression spring 54, a bezel 56, an optional plastic spacer 57, and a plastic nut 58. When the button panel assembly 45 is assembled as shown in FIGS. 6*a* and 6*b*, the compression spring 54 is contained within the bezel 56 between a lower shelf formed by the bezel 56 and an upper square portion of the actuator 52. In the illustrated embodiment, the actuator 52 includes the upper square portion and three arms extending downward from the upper square portion. It, however, is contemplated that the actuator 52 may have various other forms, so long as the actuator 52 is capable of actuating the switch 64. When the button panel assembly 45 is assembled as shown in FIGS. 6*a* and 6*b*, the lens 50 is secured to the upper square portion of the actuator 52 and extends upward above the bezel 56. The lens 50 contains a printed label describing the function of the associated button and is the portion of the button pressed by a player to cause the gaming device to perform that function. The lens 50 also serves to diffuse light emitted by a light source 60, which is one of the components of the switch assembly 60–64 connected to the printed circuit board 48. The bezel 56 is inserted into a corresponding aperture formed by the button panel 46 and is secured to the button panel 46 by the nut 58, which is threadably engaged to a threaded outer surface of the bezel 56 below the spacer 57. The spacer 57 may located immediately beneath the button panel 46 as shown, or may alternatively be located immediately above the button panel 46 to raise the button further above the button panel 46. To retain the actuator within the actuator assembly 50–58 and thereby prevent removal thereof, the lowermost ends of the respective arms of the actuator 52 are turned outward such that these ends abut a lowermost surface of the bezel 56 when the lens 50 has not been pressed.

Each switch assembly 60–64 includes the light source 60, a socket 62, and a switch 64. Because the socket 62 and the switch 64 are soldered to the printed circuit board 48, these components are depicted in the drawings as already being attached to the printed circuit board 48. When the printed circuit board assembly 47 is assembled as shown in FIGS. 6*a* and 6*b*, the light source 60 is secured within the socket 62 which, in turn, is secured to the printed circuit board 48. The light source 60 may be a lamp, light-emitting diode, or other suitable source of light. The socket 62 extends upward from the printed circuit board 48 and between the arms of the actuator 52. The upper square portion of the actuator 52 forms an aperture to allow light from the light source 60 within the socket 62 to pass therethrough and illuminate the lens 50. The switch 64 is secured to the printed circuit board 48 at a location adjacent to the socket 62 and beneath one of the arms of the actuator 52. Although the switch 64 is illustrated as a "pancake-type" mechanical switch, it is contemplate that the switch 64 may take various other forms such as a proximity switch or an optical switch.

FIGS. 6*a* and 6*b* are enlarged partial side views of the button panel system 44 embodying the present invention. The button panel 46 is generally parallel to the printed circuit board 48 and is spaced from the printed circuit board 48 such that the actuator 52 actuates the switch 64 only in response to pressing the lens 50 (see FIG. 6*b*). Pressing the lens 50 causes the actuator 52 to move in a downward direction compressing the spring 54 and actuate the switch 64. Releasing pressure on the lens 50 allows the spring 54 to cause the actuator 52 to return to its original position in which the lowermost ends of the respective arms of the actuator 52 abut the lowermost surface of the bezel 56. To insure that the actuator 52 does not damage the switch 64 in response to a player applying undue pressure to the lens 50, the arms of the actuator 52 may be designed such that they are sufficiently rigid to actuate the switch 64 but, at the same time, are sufficiently flexible to not destroy the switch 64.

In an alternative embodiment, the "pancake-type" switch 64 is replaced with an optical sensor generating an optical beam, where the optical beam is either normally "on" (uninterrupted) or normally "off" (interrupted). If the optical beam is normally "on", then the actuator 52 is configured to interrupt the optical beam in response to pressing the lens 50. However, if the optical beam is normally "off", then the actuator 52 is configured to allow passage of the optical beam in response to pressing the lens 50. In the latter case, the actuator 52 may, for example, be provided with an aperture to allow passage of the optical beam, and the printed circuit board 48 may be provided with a hole to accommodate downward movement of the actuator 52.

Figure 7A:
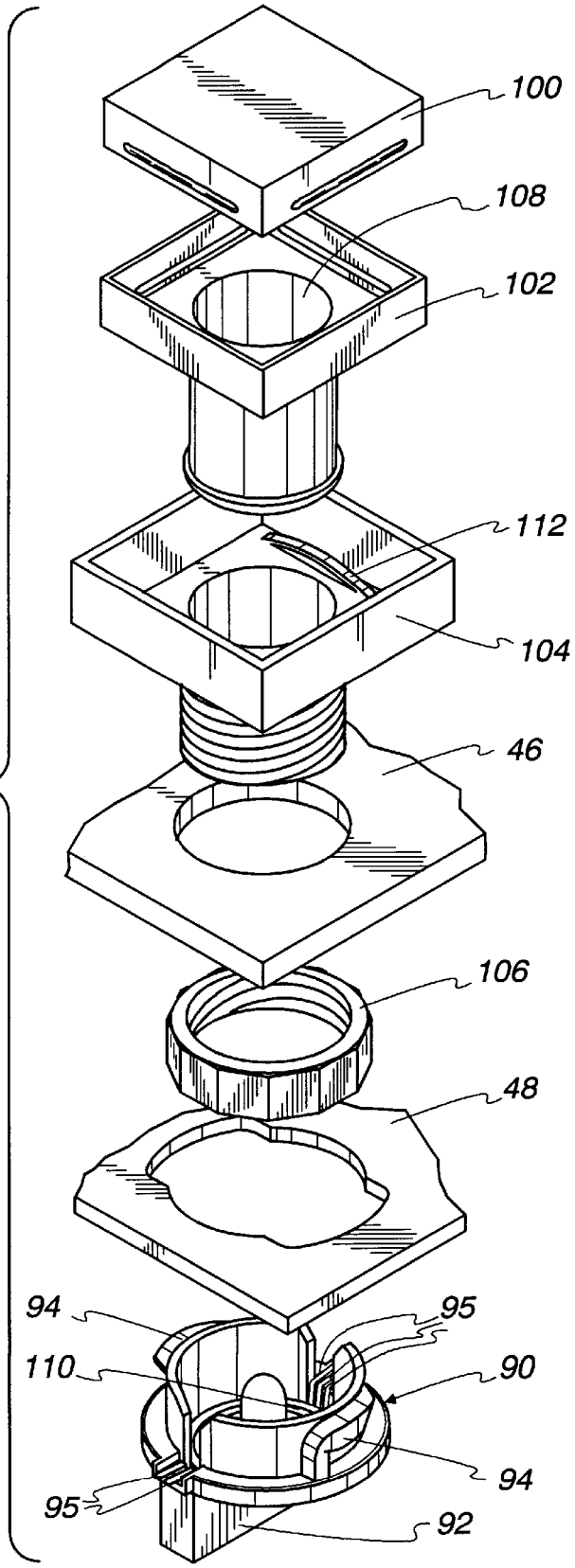
FIG. 7*a* is an enlarged exploded partial isometric view of a button panel system in accordance with an alternative embodiment of the present invention.
Figure 7B:
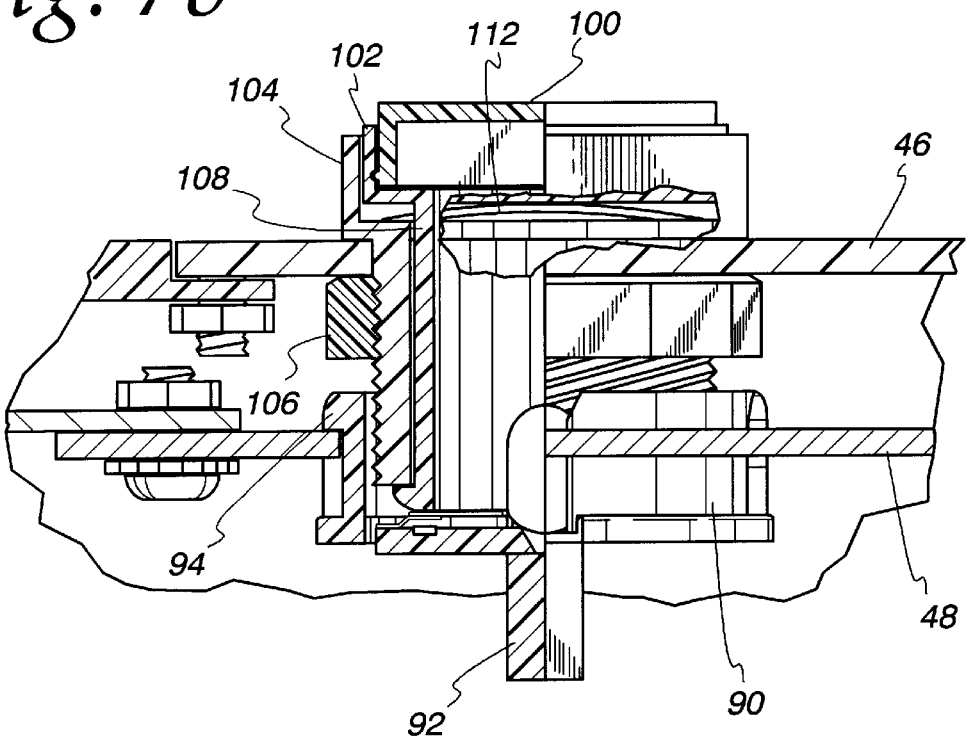
FIG. 7*b* is an enlarged partial side view of the button panel system of FIG. 7*a* with portions broken away to reveal internal structure.
Figure 7C:
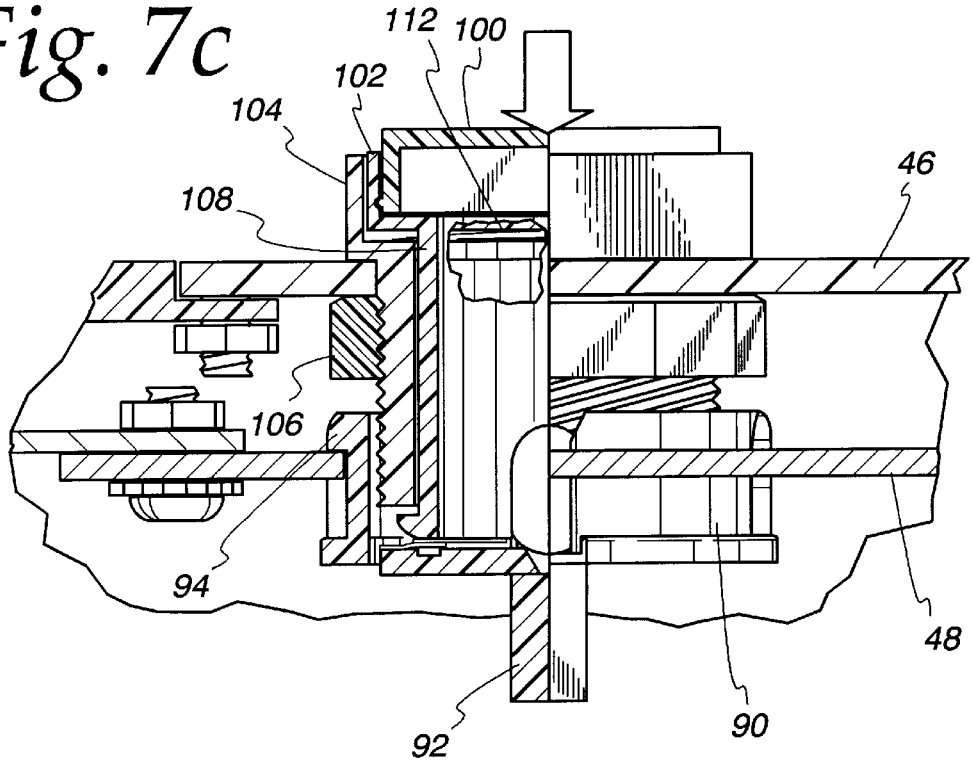
FIG. 7*c* is similar to FIG. 7*b* but showing a button being pressed to actuate a corresponding switch.

In yet another alternative embodiment shown in FIGS. 7*a–c*, the switch assembly 60–64 is replaced with a "twist-in type" switch assembly 90 in which the lamp, socket, and switch are pre-assembled as a single unit. The switch assembly 90 includes a handle 92 and a pair of opposing retaining members 94. To install the switch assembly 90, a service technician grasps the assembly 90 by the handle 92, aligns the assembly 90 with a corresponding hole in the printed circuit board 48 (FIG. 7*a*), inserts the assembly 90 through the hole, and then twists the assembly 90 such that the retaining members 94 engage the assembly 90 to the printed circuit board 48 (FIGS. 7*b* and 7*c*). Spring terminals 95 of the mounted assembly 90 electrically contact a conductive pad on the printed circuit board 48. To remove the switch assembly 90 from the printed circuit board 48, the service technician simply reverses the above steps. None of the components of the "twist-in type" switch assembly 90 is soldered to the printed circuit board 48.

The actuator assembly 50–58 in FIGS. 4–6 is slightly modified to cooperate with the switch assembly 90 in FIGS. 7*a–c*. The modified actuator assembly 100–106 in FIGS. 7*a–c* includes a lens 100, an actuator 102, a bezel 104, and a plastic nut 106. The actuator 102 includes a cylindrical shaft 108 adapted to depress a conductive ring 110 encompassing the lamp of the switch assembly 90. Instead of a conventional compression spring, the modified actuator assembly 100–106 employs a plastic leaf spring 112 molded as part of the bezel 104. Pressing the lens 100 causes the actuator 102 to move in a downward direction depressing the leaf spring 112 and actuate the switch assembly 90 (FIG. 7*c*). Releasing pressure on the lens 100 allows the spring 112 to cause the actuator 102 to return to its original position (FIGS. 7*b*). The conductive ring 110 is preferably composed at least partially of conductive rubber. This allows the switch assembly 90 to accommodate different degrees of pressure applied to the lens 100 so that the switch assembly is actuated in response to relatively light pressure on the lens 100 but is not damaged in response to heavy pressure on the lens 100.

Figure 8A:
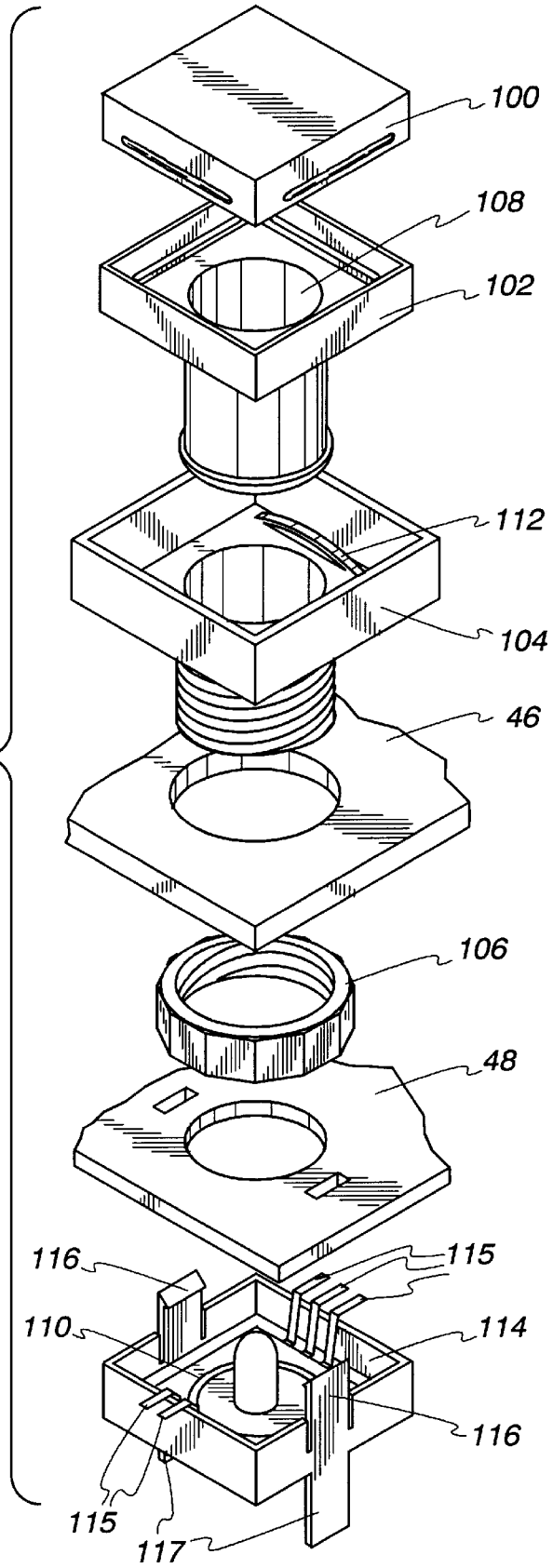
FIG. 8*a* is an enlarged exploded partial isometric view of a button panel system in accordance with another alternative embodiment of the present invention.
Figure 8B:
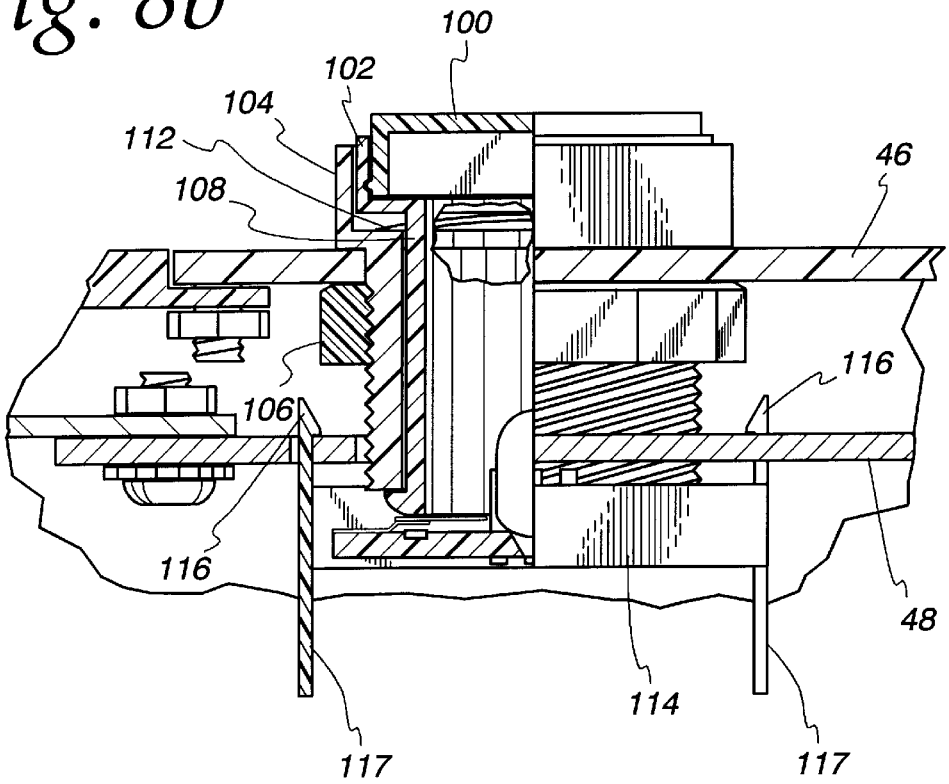
FIG. 8*b* is an enlarged partial side view of the button panel system of FIG. 8*a* with portions broken away to reveal internal structure.
Figure 8C:
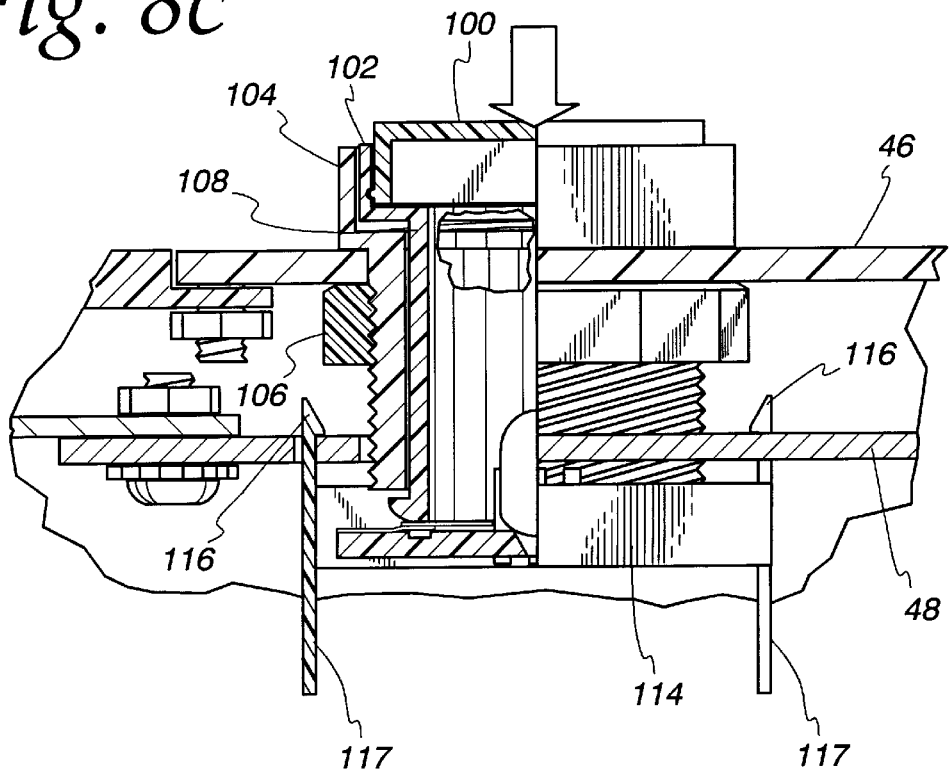
FIG. 8*c* is similar to FIG. 8*b* but showing a button being pressed to actuate a corresponding switch.

In a further embodiment shown in FIGS. 8*a–c*, the switch assembly 60–64 is replaced with a "snap-in type" switch assembly 114 in which the lamp, socket, and switch are once again pre-assembled as a single unit. The switch assembly 114 includes a pair of opposing retaining members 116 in the form of flexible clips. To install the switch assembly 114, a service technician grasps the assembly 114 by the handles 117, aligns the assembly 114 with corresponding holes in the printed circuit board 48 (FIG. 8*a*) and inserts the assembly 114 through the holes such that the clips 116 temporarily flex and then snappingly engage the assembly 114 to the printed circuit board 48 (FIGS. 8*b* and 8*c*). Spring terminals 115 of the mounted assembly 114 electrically contact a conductive pad on the printed circuit board 48. To remove the switch assembly 114 from the printed circuit board 48, the service technician simply flexes the clips 116 away from each other until they can pass through the respective holes in the printed circuit board 48. None of the components of the "snap-in type" switch assembly 114 is soldered to the printed circuit board 48. The switch assembly 114 may be actuated by an actuator assembly 100–106 of the type describe above in connection with FIGS. 7*a–c*. FIG. 8*b* depicts the actuator assembly in a non-actuating position, while FIG. 8*c* depicts the actuator assembly in an actuating position.

When the components of the button panel system 44 are assembled and attached to the gaming device, the button panel 46 itself is mounted to an outer frame section 70 of the door 32 by screws, bolts, or the like, while the printed circuit board 48 is mounted to an inner bracket 72 of the door 32 by screws, bolts, or the like. Therefore, when the door 32 is closed as shown in FIG. 3, the button panel 46 and surrounding frame section 70 are visible to a player, while the printed circuit board 48 is disposed inside the cabinet 30 and concealed from view.

Referring back to FIG. 4, the printed circuit board 48 includes a plurality of conductive traces leading from the switches 64 of the switch assemblies to an electrical connector 66 mounted to the printed circuit board 48. A mating electrical connector 68 is detachably connected to the connector 66 and is, in turn, connected to a gaming unit (not shown) inside the belly of the gaming device by a harness of electrical wires 69. A player may press various ones of the buttons to cause the gaming unit to perform various functions, such as cash out, select pay lines, display the pay table on the video display 34, enter a wager, and spin the reels.

Several advantages result from the button panel system 44 and the manner in which it is mounted to the gaming device. First, as shown in FIG. 4, the printed circuit board 48 allows the button panel system 44 to be mounted to the door 32 without having to touch the electrical wires 69 and to be easily connected to the electrical wires 69 via the single intervening connector 68. This makes it unlikely that any of the wires 69 will be pinched between the button panel system 44 and the door 32.

Second, the button panel system 44 facilitates maintenance and servicing of the switch assemblies 60–64. For example, to replace a burnt-out light source, a service technician simply disengages the printed circuit board 48 from the bracket 72 (see FIGS. 6*a–b*), removes the burnt-out light source 60 from its associated socket 62, installs a new light source, and re-mounts the printed circuit board 48 to the bracket 72. Alternatively, the service technician may disengage the button panel 46 from the frame section 70 (see FIGS. 6*a–b*) to expose the printed circuit board assembly 47, remove the burnt-out light source 60 from its associated socket 62, install a new light source, and re-mount the button panel 46 to the frame section 70. The electrical wires 69 do not hinder access to the components mounted to either the button panel 46 or the printed circuit board 48. If either the switch assembly 90 (FIGS. 7*a–c*) or 114 (FIGS. 8*a–c*) is used in place of the switch assembly 60–64, the service technician may replace disabled switch assemblies, e.g., burnt-out light sources, individually without removing the entire button panel 46 or printed circuit board 48.

Third, the button panel system 44 facilitates conversion of the gaming device from a first game requiring a first button configuration to a second game requiring a second button configuration. In one embodiment, the printed circuit board 48 is "loaded" with switch assemblies 60–64 capable of handling a variety of button configurations, but not necessarily all of these switch assemblies are used. While the printed circuit board 48 is "loaded", the button panel 46 only carries actuator assemblies 50–58 disposed in the first button configuration and arranged above corresponding ones of the switch assemblies 60–64. For example, if the printed circuit board in FIG. 4 is loaded with fourteen switch assemblies 60–64, the button panel 46 could carry fourteen or less actuator assemblies 50–58 arranged above corresponding ones of the switch assemblies 60–64. The button panel 46 preferably does not include apertures at unused locations.

During conversion of the gaming device from the first game to the second game, a service technician only needs to remove the button panel 46 and its actuator assemblies 50–58 from the gaming device and install a new button panel carrying actuator assemblies 50–58 in the second button configuration. Once again, the new button panel preferably does not include apertures at unused locations. The "loaded" printed circuit board 48 remains mounted within the cabinet 30. The gaming unit within the belly of the cabinet 30 is, of course, re-programmed or replaced to play the second game and cooperate with the second button configuration.

In an alternative embodiment, the printed circuit board 48 carries a limited number of switch assemblies 60–64 capable of supporting only a limited number of button configurations. In this case, conversion of the gaming device might require the service technician to disconnect the electrical connector 68 from the mating connector 66 on the printed circuit board 48, remove the entire button panel system 44 from the gaming device, install a new button panel system having a different button configuration, and re-connect the electrical connector 68 to the mating connector on the new printed circuit board. If either the switch assembly 90 (FIGS. 7*a–c*) or 114 (FIGS. 8*a–c*) is used in place of the switch assembly 60–64, the service technician may provide different switch configurations by adding or removing individual switch assemblies, without replacing the entire printed circuit board 48, as long as the printed circuit board includes a sufficient number of holes and associated conductive traces to accommodate the selected switch configuration.

In either type of conversion, the button panel system 44 facilitates the conversion task. Since the system 44 is easily connected and disconnected from the electrical wires 69 using the electrical connector 68, the service technician does not need to go to the trouble of reaching into the cabinet 30 and removing the electrical wires 69 during the conversion process. The electrical connector 68 and the electrical wires 69 remain within the gaming device during the conversion process. At most, the service technician must disconnect the electrical connector 68 from the mating connector 66 on the printed circuit board 48 in the situation where the printed circuit board assembly 47 is removed from the gaming device during the conversion process. The number of electrical wires 69 is preferably sufficient to accommodate any button configuration so that additional wires need not be added to the gaming device during the conversion process.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A button panel system for a gaming device including a cabinet with a hinged door, said system comprising:

a printed circuit board mounted to said door and disposed inside said cabinet;

a switch mounted to said printed circuit board;

a button panel detachably mounted to said door in proximity to said printed circuit board and exposed to a player;

a button mounted to said button panel; and an actuator coupled to said button and disposed to actuate said switch in response to pressing said button.

2. The button panel system of claim 1, wherein said switch includes an optical sensor.

3. The button panel system of claim 2, wherein said actuator actuates said optical sensor by interrupting or allowing passage of an optical beam produced by said optical sensor.

4. The button panel system of claim 1, wherein said switch includes a mechanical switch and said actuator actuates said switch by contact therewith.

5. The button panel system of claim 1, wherein said actuator is movable from a non-actuating position to an actuating position in response to pressing said button.

6. The button panel system of claim 1, wherein said button panel is generally parallel to said printed circuit board.

7. The button panel system of claim 1, wherein said switch is removably mounted to said printed circuit board.

8. The button panel system of claim 7, wherein said switch includes a pair of retaining members for releasably engaging said switch to said printed circuit board.

9. A gaming device, comprising:

a cabinet including a hinged door;

a gaming unit housed within said cabinet; and a button panel system including a printed circuit board mounted to said door and disposed inside said cabinet;

a switch mounted to said printed circuit board and electrically coupled to said gaming unit;

a button panel detachably mounted to said door in proximity to said printed circuit board and exposed to a player;

a button mounted to said button panel; and an actuator coupled to said button and disposed to actuate said switch in response to pressing said button.

10. The gaming device of claim 9, further including a plurality of slot reels.

11. The gaming device of claim 10, further including a video screen for displaying said slot reels.

12. The gaming device of claim 9, wherein said switch includes an optical sensor.

13. The gaming device of claim 12, wherein said actuator actuates said optical sensor by interrupting or allowing passage of an optical beam produced by said optical sensor.

14. The gaming device of claim 9, wherein said switch includes a mechanical switch and said actuator actuates said switch by contact therewith.

15. The gaming device of claim 9, wherein said actuator is movable from a non-actuating position to an actuating position in response to pressing said button.

16. The gaming device of claim 9, wherein said button panel is generally parallel to said printed circuit board.

17. The button panel system of claim 9, wherein said switch is removably mounted to said printed circuit board.

18. The button panel system of claim 17, wherein said switch includes a pair of retaining members for releasably engaging said switch to said printed circuit board.

19. A method of modifying a button panel system for a gaming device including a cabinet with a hinged door, said button panel system including a printed circuit board mounted to said door and disposed inside said cabinet, a plurality of switches mounted to said printed circuit board, a first button panel detachably mounted to said door in proximity to said printed circuit board and exposed to a player, a plurality of first buttons mounted to said first button panel in a first arrangement, and a plurality of first actuators coupled to said respective first buttons and disposed to actuate a first group of said plurality of switches in response to pressing said respective first buttons, said method comprising:

detaching said first button panel from said door such that said first button panel, said first buttons, and said first actuators are removed from said gaming device;

supplying a second button panel, a plurality of second buttons, and a plurality of second actuators, said second buttons being mounted to said second button panel in a second arrangement different from said first arrangement, said second actuators being coupled to said respective second buttons; and mounting said second button panel to said door in proximity to said printed circuit board such that said second actuators are disposed to actuate a second group of said plurality of switches in response to pressing said respective second buttons.

20. The method of claim 19, wherein said first and second arrangements are different from each other, and wherein said first and second groups of said plurality of switches are different from each other.

21. The method of claim 19, wherein said switches are selected from a group consisting of optical sensors, proximity sensors, and mechanical switches.

22. The method of claim 19, wherein said button panel is generally parallel to said printed circuit board.

23. A method of modifying a gaming device, said gaming device including a cabinet with a hinged door, a gaming unit housed within said cabinet for playing a first game, and a button panel system; said button panel system including a printed circuit board mounted to said door and disposed inside said cabinet, a plurality of switches mounted to said printed circuit board, a first button panel detachably mounted to said door in proximity to said printed circuit board and exposed to a player, a plurality of first buttons mounted to said first button panel in a first arrangement, and a plurality of first actuators coupled to said respective first buttons and disposed to actuate a first group of said plurality of switches in response to pressing said respective first buttons, said first group of said plurality of switches cooperating with said first game played by said gaming unit, said method comprising:

detaching said first button panel from said door such that said first button panel, said first buttons, and said first actuators are removed from said gaming device;

supplying a second button panel, a plurality of second buttons, and a plurality of second actuators, said second buttons being mounted to said second button panel in a second arrangement different from said first arrangement, said second actuators being coupled to said respective second buttons;

mounting said second button panel to said door in proximity to said printed circuit board such that said second actuators are disposed to actuate a second group of said plurality of switches in response to pressing said respective second buttons; and modifying said gaming unit to play a second game cooperating with said second group of said plurality of switches.

24. The method of claim 23, wherein said first and second arrangements are different from each other, and wherein said first and second groups of said plurality of switches are different from each other.

25. The method of claim 23, wherein said switches are selected from a group consisting of optical sensors, proximity sensors, and mechanical switches.

26. The method of claim 23, wherein said button panel is generally parallel to said printed circuit board.

27. A printed circuit board assembly for a gaming device, said gaming device including a button panel, a button, and an actuator, said button being mounted to said button panel, said actuator being coupled to said button and disposed to actuate said switch in response to pressing said button, said assembly comprising:

a printed circuit board mounted to a housing of said gaming device, said printed circuit board including an aperture; and a switch assembly removably mounted to said printed circuit board through said aperture and disposed to be actuated by said actuator in response to pressing said button.

28. The printed circuit board assembly of claim 27, wherein said switch assembly includes a pair of retaining members for releasably engaging said switch assembly to said printed circuit board.

29. The printed circuit board assembly of claim 28, wherein said switch assembly is mounted to said printed circuit board by inserting said switch assembly through said aperture and then rotating said switch assembly.

30. The printed circuit board assembly of claim 28, wherein said retaining members are flexible clips adapted to temporarily flex and snappingly engage said switch assembly to said printed circuit board.

* * * * *